United States Patent [19]

Hyner et al.

[11] 4,188,459

[45] Feb. 12, 1980

[54] CORROSION RESISTANT PLATING AND METHOD UTILIZING ALLOYS HAVING MICRO-THROWING POWER

[75] Inventors: Jacob Hyner, Waterbury; Steven Gradowski, Torrington; Thomas F. Maestrone, East Hartford, all of Conn.

[73] Assignee: Whyco Chromium Company, Inc., Thomaston, Conn.

[21] Appl. No.: 946,396

[22] Filed: Sep. 27, 1978

[51] Int. Cl.[2] ..... B32B 15/00; B32B 15/18

[52] U.S. Cl. ..... 428/648; 85/1 C; 204/41; 427/405; 427/406; 428/658; 428/659; 428/667; 428/674; 428/675; 428/678; 428/679

[58] Field of Search ..... 204/41; 427/405, 406; 85/41, 1 C, 47; 428/935, 658, 657, 659, 679, 648, 675, 667, 674, 678

[56] References Cited

U.S. PATENT DOCUMENTS

| | | | |
|---|---|---|---|
| 1,651,278 | 11/1927 | Humphries | 428/666 |
| 1,835,636 | 12/1931 | Corbit | 428/667 |
| 1,931,704 | 10/1933 | Moore et al. | 428/635 |
| 2,124,657 | 7/1938 | Ritzenthaler et al. | 428/657 |
| 3,247,082 | 4/1966 | Du Rose | 428/934 |
| 3,249,409 | 5/1966 | McLeod | 428/657 |
| 3,884,116 | 5/1975 | Hage | 85/1 C |
| 4,091,173 | 5/1978 | Hage | 428/657 |

FOREIGN PATENT DOCUMENTS

| | | | |
|---|---|---|---|
| 811573 | 4/1959 | United Kingdom | 85/1 C |

*Primary Examiner*—Arthur J. Steiner
*Attorney, Agent, or Firm*—DeLio and Montgomery

[57] ABSTRACT

A multi-layer plating and method for improving the corrosion resistance of ferrous metal articles, such as steel fasteners, are provided in accordance with the invention. The multi-layer plating comprises, in sequence over a ferrous metal substrate, a layer of an alloy which has micro-throwing power, such as nickel-cadmium, nickel-zinc, iron-cadmium, iron-zinc, cobalt-cadmium, or cobalt-zinc, a layer of cadmium, cadmium-tin alloy, a dual layer of cadmium and tin, zinc or zinc alloy, a layer of copper, a layer of nickel, and a layer of chromium or a metallic chromium substitute. The method comprises plating, and preferably electroplating, the aforementioned layers of alloy and metals over an article having a ferrous metal substrate to obtain improved corrosion resistance.

11 Claims, No Drawings

CORROSION RESISTANT PLATING AND METHOD UTILIZING ALLOYS HAVING MICRO-THROWING POWER

BACKGROUND OF THE INVENTION

The present invention relates to the field of metal plating, and more specifically, to a multi-layer plating and method for improving the corrosion resistance of articles having a ferrous metal substrate and which exhibit satisfactory appearance for commercial utilization, preferably either bright or dull chromium or chromium-substitute finished articles.

A persistant problem in the technical field has been to provide ferrous metal articles which are resistant to corrosion which inherently attacks such articles in normal usage. With some ferrous metal articles, the need to provide the maximum degree of corrosion resistance is particularly great in view of the corrosive environments in which they are utilized. For example, metal fasteners which are utilized extensively in automotive as well as other industrial applications are typically exposed to corrosive salts and other corrosive agents which would result in rapid deterioration, both functionally and aesthetically, of such articles.

It is known that the corrosion resistance of ferrous metal articles, particularly steel fasteners, can be obtained by applying metallic coatings, either in single or multiple layers, over the ferrous metal substrate. Such a layer or layers of metal provide either greater inherent resistance to corrosion than the ferrous metal substrate, or they are "sacrificial" in that they are preferentially attacked by corrosive agents.

For example, it is known that improvement in the corrosion resistance of a ferrous metal substrate can be achieved by applying sequential layers of copper, cadmium, copper, nickel, and chromium or a chromium substitute comprised of alloys of tin-nickel, tin-cobalt or tin-cobalt-nickel. This plating sequence has been utilized in the U.S. automotive industry, particularly on steel fasteners.

However, further improvement in the corrosion resistance even of such plated ferrous metal articles is still necessary, particularly in view of the present trend of automobile owners to use their vehicles over a longer period of time and greater mileage. Also, improvement is needed in the reliability with which such multi-layer platings can be applied to ferrous metal articles. It is particularly difficult to achieve good, reliable corrosion resistance by multi-layer platings on ferrous metal articles which have a rough, uneven surface, such as results from producing the article by heading operations. The surface of these types of articles can contain pits, laps, cracks, scratches, surface defects and other irregularities which make uniform plating onto the surface difficult. Conventional plating sequences are incapable of completely and uniformly coating the aforementioned defects.

SUMMARY OF THE INVENTION

In accordance with the present invention, a novel multi-layer metallic plating is provided to improve the corrosion resistance of ferrous metal substrates. It comprises, in sequence over the ferrous metal substrate, a layer of an alloy which has micro-throwing power, a layer of cadmium, cadmium-tin alloy, a dual layer of cadmium and tin, zinc or zinc alloy, a layer of copper, a layer of nickel, and a layer of chromium or a metallic chromium-substitute. Preferably, the first layer alloy used is either nickel-cadmium, nickel-zinc, iron-cadmium, iron-zinc, cobalt-cadmium, cobalt-zinc or a ternary or quaternary alloy containing iron, nickel or cobalt in combination with cadmium or zinc.

Furthermore, a method is provided in accordance with the invention for improving the corrosion resistance of a ferrous metal substrate. This method comprises sequentially plating, over the ferrous metal substrate, a layer of an alloy which has micro-throwing power, a layer of cadmium, cadmium-tin alloy, a dual layer of cadmium and tin, zinc or zinc alloy, a layer of copper, a layer of nickel, and a layer of chromium or a metallic chromium-substitute. Preferably, the aforementioned layers of metal are applied by electroplating. The aforementioned preferred first layer alloys are utilized in accordance with the preferred method of the invention.

It has been discovered that the novel multi-layer platings and method of the invention provide a reliable, uniform coating of corrosion resistant metal plating, most notably over ferrous metal articles having surface defects, pits, cracks, laps or the like. It is believed that a primary reason for this substantial improvement stems from the micro-throwing power of the alloys utilized as the first layer over the ferrous metal substrate.

It is an object of the present invention to provide a novel multi-layer plating which can be reliably and uniformly applied over a ferrous metal substrate and will provide superior corrosion resistance.

It is also an object of the invention to provide a useful and novel method for imparting superior corrosion resistance to a ferrous metal article, preferably a fastener, as well as a chromium or chromium-like finish which is of an acceptable commercial quality, both for bright or dull finish appearance.

Other objects and advantages of the multi-layer plating and method of the invention will be readily apparent to those skilled in the art through the study of the following description of the preferred embodiments and the appended claims.

DETAILED DESCRIPTION OF THE PREFERRED EMBODIMENTS

The metal substrate upon which the novel multi-layer plating of the invention is applied can be any ferrous metal or alloy thereof. For example, iron and various types of steel are preferably utilized.

It is within the purview of the invention that the type of ferrous metal substrate or the form in which it is provided for treatment in accordance with the invention is not limited. Preferably, however, it has been found that the multi-layer plating of this invention is particularly useful and advantageous when applied to steel fasteners, such as those which are used throughout the automotive industry. The surface of such ferrous metal articles typically may be rough and irregular, in that it may contain surface defects, such as pits, cracks, laps, or voids, some of which may be as small as 0.00002 inches.

In addition to steel fasteners, which are preferred articles which benefit from application of the multi-layer plating of the invention, it is within the purview of the invention that the multi-layer plating and method can be applied to any article having a ferrous metal substrate, such as screw machine or eyelet parts, stampings or the like of various shapes and sizes. In particular, articles having a chrome finish for automotive use, such as fasteners, bumpers, decorative trim or the like, can be beneficially treated in accordance with the invention.

While not being limited to any theory or explanation, it is nevertheless believed that the superior corrosion resistance provided in accordance with the invention results in part from the ability of the alloys utilized in the first layer, which is applied directly over the ferrous metal substrate, to exhibit micro-throwing power and thereby preferentially plate in surface defects. For purposes of the invention, it is to be understood that "micro-throwing power" refers to the characteristic of an alloy (hereinafter sometimes referred to as a "micro-throwing alloy") to deposit and form a layer which is even thicker inside of the surface defects, seams, pits or the like, than on the plane surface from which the surface defect is formed.

It is within the purview of the invention that the preferred micro-throwing alloys used contain a first metal component selected from either iron, cobalt or nickel and a second metal component selected from zinc or cadmium. Preferably, the iron, cobalt or nickel component comprises 97 to 99.9% by weight of the alloy, while the zinc or cadmium component comprises 0.1 to 3.0% by weight. Most preferably, the zinc or cadmium component comprises about 2.5% by weight of the alloy with the iron, cobalt or zinc component comprises the balance.

Preferably, nickel-cadmium, nickel-zinc, iron-cadmium, iron-zinc, cobalt-cadmium and cobalt-zinc alloys are utilized in accordance with the invention. More preferably, nickel-cadmium and nickel-zinc are advantageously utilized. Nevertheless, it is within the full purview of the invention that equivalent alloys which exhibit micro-throwing power can be utilized in accordance with the invention. Furthermore, any ternary or quaternary alloy containing iron, cobalt and/or nickel, as well as zinc and/or cadmium can also be advantageously utilized.

Furthermore, it is within the purview of the invention that the first layer comprising any alloy having micro-throwing power can be provided in any acceptable thickness, preferably the thickness ranges between 0.0005 to 0.00005 inches.

Following the first layer of micro-throwing alloy, a layer of a metal which is galvanically protective, or an alloy thereof, such as cadmium, cadmium-tin alloy, a dual layer of cadmium and tin, zinc or zinc alloy, is applied. Next, a layer of copper is applied, followed by a layer of nickel. Each of these layers if preferably provided in a thickness ranging between about 0.0001 to 0.001 inches and are applied from conventional plating baths for each metal or alloy, preferably by electroplating. It is, nevertheless, within the purview of the invention that these layers of metal or alloys thereof can be applied in any suitable manner from any type of plating bath or coating process.

Finally, a layer of chromium or metallic chromium substitute is applied over the layer of nickel. This layer is preferably 0.00001 to 0.00005 inches in thickness and may also be applied from a conventional plating bath, preferably by electroplating.

The chromium substitutes which may be utilized in accordance with the invention, include but are not limited to, the ternary alloys disclosed and claimed in U.S. Pat. No. Re29,239, which is hereby incorporated by reference. These metals and alloys can all be utilized to provide performance qualities and/or appearance which may be substituted for chromium. The preferred metallic chromium substitutes are the aforementioned ternary alloys of tin, cobalt and a third metal which is either antimony, zinc or a metal of Periodic Table Group $III_A$ or $VI_B$.

These chromium substitutes are applied as metallic layers in place of or in combination with chromium as the final layer in the multi-layer plating and method of the invention. For example, the preferred ternary alloys may be applied from aqueous plating bath formulations and utilizing electroplating conditions, as disclosed in the aforementioned U.S. Pat. No. Re29,239, which is incorporated herein by reference.

It is also within the purview of the invention that other ternary alloys including substantial portions of tin and cobalt, as well as simple binary alloys of tin and cobalt, may be utilized as chromium substitutes. However, these materials do not provide the superior performance or appearance of the aforementioned ternary alloys disclosed and claimed in U.S. Pat. No. Re29,239.

Each layer of the multi-layer plating of the invention may be applied in any conventional manner, utilizing any conventional bath or method for application of the metal or alloy.

Since it is preferred that the micro-throwing alloy comprising the fist layer is electroplated, conventional electroplating baths and techniques are employed. For example, nickel-cadmium alloys can be electroplated from sulfate or sulfate-chloride type baths, as are conventionally known and commercially available. Likewise, nickel-zinc alloys can be plated from chloride, sulfate, sulfamate, ammonical or pyrophosphate type baths. Iron-zinc and iron-cobalt can be plated from chloride or sulfate type baths. Cobalt-zinc or cobalt-cadmium alloys can be plated from sulfate or ammonical type baths. It is within the purview of the invention that any suitable plating bath or solution capable of depositing micro-throwing alloys can be utilized by one skilled in the art.

Likewise, the other layers can each be applied by conventional baths and methods for the respective metal or alloy involved.

For example, the following bath formulations are among those which can be utilized, as required, to plate the desired metal or alloy layer:

| | |
|---|---|
| Nickel-Cadmium Alloy Bath | |
| $NiSO_4 \cdot 7H_2O$ | 350 g/l |
| $NiCl_2 \cdot 6H_2O$ | 45 g/l |
| Boric Acid | 40 g/l |
| Gelatin | 5 g/l |
| Cadmium Sulfate | 1.08–3.6 g/l |
| Operating Conditions | |
| Temperature | 57° C. |
| Current Density | 16 amp/dm$^2$ |
| pH | about 6.0 |
| Nickel-Zinc Alloy Bath | |
| $NiCl_2 \cdot 6H_2O$ | 300 g/l |
| $ZnCl_2$ | 155 g/l |
| Plating Conditions | |
| Temperature | 75° C. |
| Current Density | 0.05 amp/dm$^2$ |
| pH | 2.3 |
| Iron-Zinc Alloy Bath | |
| $FeSO_4 \cdot 7H_2O$ | 250 g/l |
| $ZnSO_4 \cdot 7H_2O$ | 26 g/l |
| Plating Conditions | |
| Temperature | 90° C. |
| Current Density | 2 amp/dm$^2$ |
| pH | Acid 0.01N |

-continued

| | |
|---|---|
| Cadmium Bath | |
| Cadmium Oxide | 31.5 g/l |
| Sodium Cyanide | 142.3 g/l |
| Plating Conditions | |
| Temperature | 23.9°-32.2° C. |
| Current Density | 5-150 amp/ft$^2$ |
| Copper Bath | |
| Copper Metal | 30 g/l |
| Sodium Cyanide | 15 g/l |
| Rochelle Salts | 40 g/l |
| Sodium Copper Cyanide | 43 g/l |
| Plating Conditions | |
| Temperature | 140° F. |
| pH | 9.8-10.5 |
| Current Density | 0.5-200 amp/ft$^2$ |
| Nickel Bath | |
| Nickel Metal | 45 g/l |
| Chloride | 20 g/l |
| Boric Acid | 45 g/l |
| Plating Conditions | |
| Temperature | 140° F. |
| pH | 4.0-4.5 |
| Current Density | 0.5-200 amp/ft$^2$ |
| Chromium Bath | |
| Chromic Acid | 299.6 g/l |
| Sulphuric Acid | 3.0 g/l |
| Plating Conditions | |
| Temperature | 40°-54° C. |
| Current Density | 144-432 amp/ft$^2$ |
| Chromium Substitute Bath (Co/Sn/Zn) | |
| Cobalt Chloride | 20-200 g/l |
| Stannous Chloride | 10-100 g/l |
| Ammonium Bifluoride | 20-400 g/l |
| Hydrochloric Acid (37%) | 40-150 ml/l |
| Ammonium Hydroxide (28%) | 10-50 m/l |
| Zinc Chloride | 15-175 g/l |
| Plating Conditions | |
| Temperature | 60°-80° C. |
| Current Density | 10-20 amp/ft$^2$ |
| pH | 1-3 |

EXAMPLE 1

In accordance with the method of the invention, several steel fasteners were electroplated with sequential layers of nickel-cadmium alloy, cadmium, copper, nickel and chromium. The steel fasteners were made cathodic and electroplated with the aforementioned sequential layers using the aforementioned plating baths for each respective alloy and metal. The layer of nickel-cadmium alloy comprised about 2.5% by weight of cadmium and was electroplated to a thickness of about 0.0002 inches, the respective layers of cadmium, copper and nickel were plated to a thickness of 0.0004 inches and the layer of chromium was plated to a thickness of 0.00002 inches.

These plated fasteners consistently passed 25 hours of CASS testing.

EXAMPLE 2

As in Example 1, several steel fasteners were electroplated with the same sequential layers in accordance with the invention, except that nickel-zinc alloy (comprising about 2.5% by weight of zinc) was substituted in place of the first layer of nickel-cadmium alloy of Example 1.

These plated fasteners consistently passed 25 hours of CASS testing.

EXAMPLE 3

As in Example 1, several steel fasteners were electroplated with the same sequential layers, except that iron-zinc alloy (comprising about 2.5% by weight of zinc) was substituted for the nickel-cadmium alloy in Example 1.

Again, the plated fasteners consistently passed 25 hours of CASS testing.

EXAMPLE 4

Example 3 was repeated, except that an iron-cadmium alloy was substituted for the iron-zinc alloy of Example 3 as the first layer.

Likewise, these plated fasteners consistently passed 25 hours of CASS testing.

EXAMPLE 5

As in Example 1, several steel fasteners were electroplated with the same sequential layers, except that a cobalt-cadmium alloy was substituted for the nickel-cadmium alloy used in Example 1.

The plated fasteners consistently passed 25 hours of CASS testing.

EXAMPLE 6

As in Example 5, several steel fasteners were electroplated with the same sequential layers, except that a cobalt-zinc alloy was substituted for the cobalt-cadmium alloy used in Example 5.

Again, the plated fasteners consistently passed 25 hours of CASS testing.

As will be readily apparent to one skilled in the art, various modifications may be made in the details of the method and multi-layer plating of the invention to provide an improved and reliable degree of corrosion resistance to a ferrous metal substrate and thereby provide a chromium or chromium-like finish article having superior corrosion resistance. As indicated previously, various conventional methods of plating the metallic compositions for each of the metals and alloys utilized as layers of the multi-layer plating may be utilized, including but not limited to electroplating, electroless-plating and other conventional application techniques. Of course, it is fully within the purview of the invention that the form of the ferrous metal substrate upon which the novel multi-layer plating of the invention can be applied can comprise any article of manufacture which can be formed therefrom and which will benefit from the superior corrosion resistance provided by the invention.

What is claimed is:

1. A multi-layer plating for providing improved corrosion resistance to a ferrous metal substrate comprising, in sequence:

(a) a layer of an alloy having micro-throwing power, (b) a layer of a galvanically protective metal which is selected from the group consisting of cadmium, cadmium-tin alloy, a dual layer of cadmium and tin, zinc or zinc alloy, (c) a layer of copper, (d) a layer of nickel, and (e) a layer of chromium or a metallic chromium substitute selected from the group consisting of a ternary alloy comprising cobalt, tin and a third metal selected from antimony, zinc or a metal of Periodic Group $III_A$ or $VI_B$, and a binary alloy comprising cobalt or tin.

2. The multi-layer plating of claim 1 wherein said alloy having micro-throwing power is selected from the group consisting of nickel-cadmium, nickel-zinc, iron-cadmium, iron-zinc, cobalt-cadmium, cobalt-zinc or a ternary or quaternary alloy containing at least one metal selected from iron, nickel or cobalt and a second component selected from the group consisting of cadmium or zinc.

3. The multi-layer metallic plating of claim 1 wherein the thickness of said layer of alloy having micro-throwing power ranges between about 0.0005 to 0.00005 inches, the thickness of each respective layer of said metal which is galvanically protective, said layer of copper and said layer of nickel each range between about 0.001 to 0.0001 inches, and said layer of chromium or chromium substitute ranges from about 0.00001 to 0.00005 inches.

4. The multi-layer metallic plating of claim 3 wherein the thickness of said alloy having micro-throwing power is about 0.0002 inches, the thickness of each of the respective layers of metal which is galvanically protective, layer of copper and layer of nickel is each about 0.0004 inches, and the thickness of the layer of said chromium or chromium substitute is about 0.00002 inches.

5. An article having a ferrous metal substrate and exhibiting a chrome-like finish and improved corrosion resistance comprising, in sequence:

(a) ferrous metal as the structural base of said article,
(b) a layer over said ferrous metal of an alloy having micro-throwing power,
(c) a layer of a galvanically protective metal which is selected from the group consisting of cadmium, cadmium-tin alloy, a dual layer of cadmium and tin, zinc or zinc alloy,
(d) a layer of copper,
(e) a layer of nickel, and
(f) a layer of chromium or a metallic chromium substitute selected from the group consisting of a ternary alloy comprising cobalt, tin or a third metal selected from antimony, zinc or a metal of Periodic Group $III_A$ or $VI_B$, and a binary alloy comprising cobalt and tin.

6. The article of claim 5 wherein said alloy which has micro-throwing power is selected from the group consisting of nickel-cadmium, nickel-zinc, iron-cadmium, iron-zinc, cobalt-cadmium, cobalt-zinc or a ternary or quaternary alloy consisting at least one metal selected from iron, nickel or cobalt and a second component selected from the group consisting of cadmium or zinc.

7. The article of claim 5 wherein the thickness of said layer of alloy having micro-throwing power ranges between about 0.0005 to 0.00005 inches, the thickness of each respective layer of said metal which is galvanically protective, said layer of copper and said layer of nickel each range between about 0.001 to 0.0001 inches, and said layer of chromium or chromium substitute ranges from about 0.00001 to 0.00005 inches.

8. In the article of claim 5 wherein said article is a fastener.

9. A steel fastener having a chrome-like finish and improved corrosion resistance comprising, in sequence:

(a) a structural base formed of steel,
(b) a layer plated over said steel selected from the group consisting of nickel-cadmium, nickel-zinc, iron-cadmium, iron-zinc, cobalt-cadmium, cobalt-zinc or a ternary or quaternary alloy containing at least one metal selected from iron, nickel or cobalt and a second component selected from the group consisting of cadmium or zinc,
(c) a layer of metal or alloy which is galvanically protective selected from the group consisting of cadmium, cadmium-tin alloy, a dual layer of cadmium and tin, zinc or a zinc alloy,
(d) a layer of copper,
(e) a layer of nickel, and
(f) a layer of chromium or metallic chromium substitute selected from the group consisting of a ternary alloy comprising cobalt, tin and third metal selected from antimony, zinc or a metal of Periodic Group $III_A$ or $VI_B$, any binary alloy comprising cobalt and tin.

10. A method of improving the corrosion resistance of an article having a ferrous metal substrate comprising sequentially plating over said ferrous metal substrate:

(a) a layer of alloy having micro-throwing power,
(b) a layer of galvanically protective metal which is selected from the group consisting of cadmium, cadmium-tin alloy, a dual layer of cadmium and tin, zinc or zinc alloy,
(c) a layer of copper,
(d) a layer of nickel, and
(e) a layer of chromium or metallic chromium substitute selected from the group consisting of a ternary alloy comprising cobalt, tin or a third metal selected from antimony, zinc or a metal of Periodic Group $III_A$ or $VI_B$, and a binary alloy comprising cobalt and tin.

11. The method of claim 10 wherein said alloy having micro-throwing power is selected from the group consisting of nickel-cadmium, nickel-zinc, iron-cadmium, iron-zinc, cobalt-cadmium, cobalt-zinc or a ternary or quaternary alloy containing at least one metal selected from iron, nickel or cobalt and a second component selected from the group consisting of cadmium or zinc.

* * * * *

UNITED STATES PATENT AND TRADEMARK OFFICE

CERTIFICATE OF CORRECTION

PATENT NO. : 4,188,459

DATED : February 12, 1980

INVENTOR(S) : Jacob Hyner, Steven Gradowski and Thomas F. Maestrone

It is certified that error appears in the above-identified patent and that said Letters Patent are hereby corrected as shown below:

Column 4, line 26 "fist" should be --first--

Column 7, line 45 "consisting" should be --containing--

Signed and Sealed this

*Twenty-eighth* Day of *October 1980*

[SEAL]

*Attest:*

SIDNEY A. DIAMOND

*Attesting Officer*

*Commissioner of Patents and Trademarks*